United States Patent [19]

Blakely

[11] 4,062,381

[45] Dec. 13, 1977

[54] REPAIR PART FOR MAGAZINE TIP GUIDE OF LOOM WINDER

[75] Inventor: James T. Blakely, Laurens, S.C.

[73] Assignee: Blakely Industries, Greenville, S.C.

[21] Appl. No.: 744,921

[22] Filed: Nov. 26, 1976

[51] Int. Cl.[2] ..... D03D 45/00; D03D 45/26

[52] U.S. Cl. ..... 139/224 A; 139/247; 139/251

[58] Field of Search ..... 139/224 A, 224 R, 245–247, 139/251; 242/27, 35.5

[56] References Cited

U.S. PATENT DOCUMENTS

| | | | |
|---|---|---|---|
| 1,210,489 | 1/1917 | King et al. | 139/251 |
| 2,766,779 | 10/1956 | Goodhue et al. | 139/247 |

*Primary Examiner*—James Kee Chi

*Attorney, Agent, or Firm*—B. P. Fishburne, Jr.

[57] ABSTRACT

The magazine tip guide of an automatic loom filling winder is subjected to constant pounding by the quill tip support as quills are transferred into the shuttle. Eventually a section is broken out of the magazine tip guide and the replacement of this component and its refitting on the loom winder are costly and time consuming. To avoid the necessity for replacing the entire tip guide, a simple and economical part is installed between the outer side of the tip guide and the rockable quill tip support, and this repair or replacement part has a slot which registers with the slotted portion of the magazine tip guide which has been fractured. The normal operation of the magazine tip guide and quill tip support is not interfered with by the invention.

3 Claims, 6 Drawing Figures

REPAIR PART FOR MAGAZINE TIP GUIDE OF LOOM WINDER

BACKGROUND OF THE INVENTION

The invention is an improvement on an automatic loom filling winder of the class disclosed in U.S. Pat. No. 2,638,936 to Goodhue et al., issued May 19, 1953. The advantages of such an automatic loom filling winder are recognized in the art and a widely used commercial loom filling winder is manufactured and sold by Leesona Corporation of Warwick, R.I. under the registered mark "UNIFIL".

More particularly, the invention is concerned with the repair of a critical and rather costly component of the loom filling winder which frequently breaks during loom operation, because it is subjected to repetitive hard pounding each time a quill is transferred by a transfer hammer from the loom winder into the shuttle. The tip of each quill being transferred rides through a magazine tip guide on which is rockably mounted a quill tip support. An extension or arm of the quill tip support moves within a slot near the bottom of the magazine tip guide, and the quill transfer operation causes the extension or arm to strike the bottom of the slot rapidly and repeatedly. Frequently, a lower section of the magazine tip guide at the end of this slot will fracture and break away from the wall of the tip guide rendering the latter useless.

It has been customary to replace the entire magazine tip guide, which is a comparatively expensive part. It is also time consuming and requires substantial skill to refit a new magazine tip guide on the automatic loom winder.

The present invention deals with this troublesome and somewhat costly problem in the art in an extremely simple and economical manner, which completely avoids the necessity for replacing and refitting a broken magazine tip guide and allows the same to continue in service with a simple one-piece repair part installed thereon in such a way that the repair part is held in place solely by existing elements on the magazine tip guide without interfering in the slightest manner with the normal functioning of these elements or the normal functioning of the entire magazine tip guide during the quill transfer operation. The simple replacement part can be installed in minimum time by a comparatively unskilled mechanic and, once installed, the damaged magazine tip guide is instantly restored to full utility without adjustment, and in fact, following the repair, is stronger than ever. The repair part does not have to be attached to the tip guide with threaded fasteners, rivets or by welding and no drilling or other cutting of the metal of the magazine tip guide is necessary. The replacement or repair element is of simple plate-like formation and is simply suspended from an existing pivot shaft for the quill tip support on the magazine tip guide. The repair part is contoured to engage a wall of the magazine tip guide in such a way that the part cannot be displaced from its working position once it is installed. The repair part contains a slot for the arm or extension of the quill tip support and serves the same function as the original slot of the magazine tip guide which has been broken away by constant pounding of the quill tip support.

Other features and advantages of the invention will become apparent during the course of the following description.

DETAILED DESCRIPTION

Figure 1:
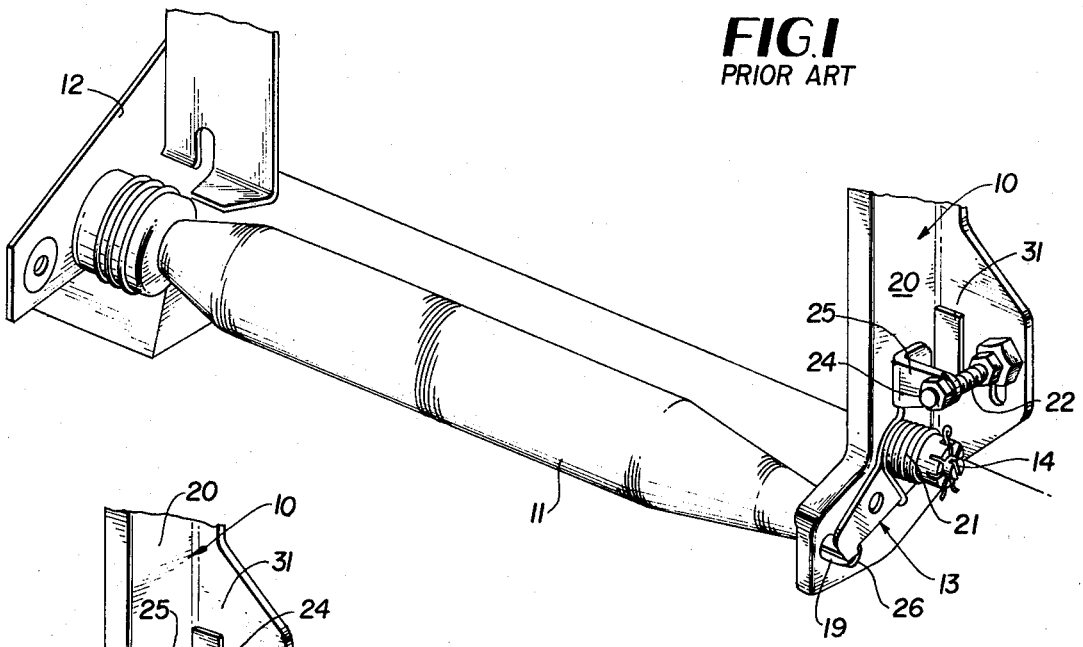
FIG.1 PRIOR ART
FIG. 1 is a perspective view of a fragmentary portion of an automatic loom filling winder showing particularly a magazine tip guide, a rockable quill tip support and associated elements according to the prior art.
Figure 2:
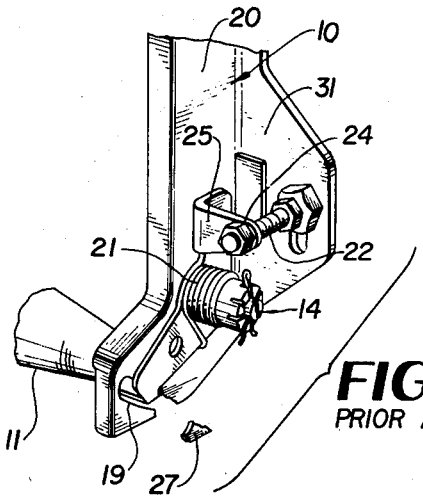
FIG.2 PRIOR ART
FIG. 2 is a fragmentary perspective view illustrating the breakage or failure of the magazine tip guide in the prior art.
Figure 6:
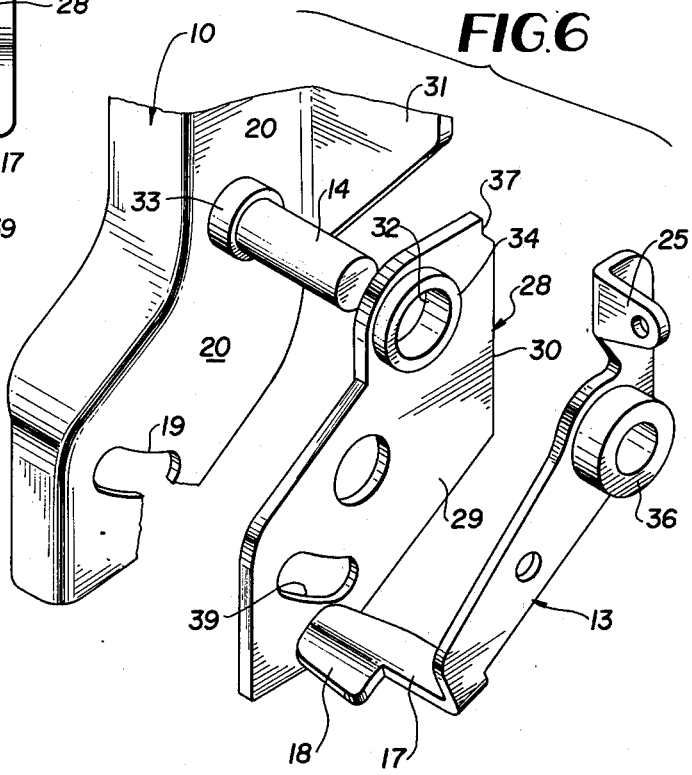
FIG. 6 is an exploded perspective view of the invention.

Referring to the drawings in detail wherein like numerals designate like parts, and referring first to FIGS. 1 and 2 which show the prior art, the numeral 10 designates a magazine tip guide for guiding the tip of a bobbin or quill 11 in conjunction with an opposing butt guide 12 as the quill descends to its transfer position in an automatic loom filling winder, of the type disclosed in above-referenced U.S. Pat. No. 2,638,936. The prior art mechanism also includes a quill tip support 13 rockably mounted adjacent the outer side of the tip guide 10 on a shaft extension 14 of a threaded stud 15, FIG. 5, secured within a threaded opening 16 of the tip guide 10. The rockable quill tip support 13 includes a right angular extension 17 having a quill tip engaging lip 18, FIG. 6. The extension 17 travels back and forth through an arcuate slot 19 formed in the side wall 20 of the tip guide 10 near its lower end, the lip 18 being disposed inwardly of the side wall 20 to engage and support the tip of each quill at the proper moment.

The quill tip support 13 is biased upwardly toward the top end of slot 19 by a torsion spring 21 having a connection with the support 13, as illustrated. The quill tip support can be adjusted on the pivot shaft 14 relative to the slot 19 by a threaded stud 22 secured to a projection 31 on the magazine tip guide and a cooperating nut 24 arranged forwardly of a lug 25 on the quill tip support 13. All of this is conventional prior art construction, the operation of which is well known in the art.

When a quill or bobbin 11 is transferred from the position shown in FIG. 1 into a shuttle on the loom, the transfer is made by a hammer, not shown, which causes the extension 17 to be driven abruptly with considerable force against the lower end 26 of slot 19. This is a repetitive action and the constant impact can and frequently does fracture the tip guide 10 near the bottom of the slot 26 causing a small section 27, FIG. 2, to be broken out. When this happens, the entire magazine tip guide 10 is rendered useless, for thereafter the quill tip support 13 will travel too far down causing other quills to fall out or be improperly positioned for transfer. It has been the custom in the prior art to deal with this problem by replacing the comparatively expensive magazine tip guide 10 in its entirety. When this is done, a considerable amount of time is consumed by skilled personnel to install and adjust properly a new magazine tip guide 10.

As previously noted, the sole purpose of this invention is to deal with the problem of a broken tip guide 10 in an entirely different and much more economical manner which avoids the necessity for removing the broken tip guide and installing a new one with the attendant cost and equipment down time. Instead of this, a single simplified small one-piece repair or replacement part 28 is installed on the damaged magazine tip guide 10 between its side wall 20 and the adjacent rockable quill tip support 13. This simple addition to the assembly completely restores the damaged tip guide to full utility, in fact rendering it stronger than ever, and the repair part 28 in no way interferes with or changes the normal operation of the conventional elements 10 and 11 or any other parts of the automatic loom filling winder.

Figure 3:
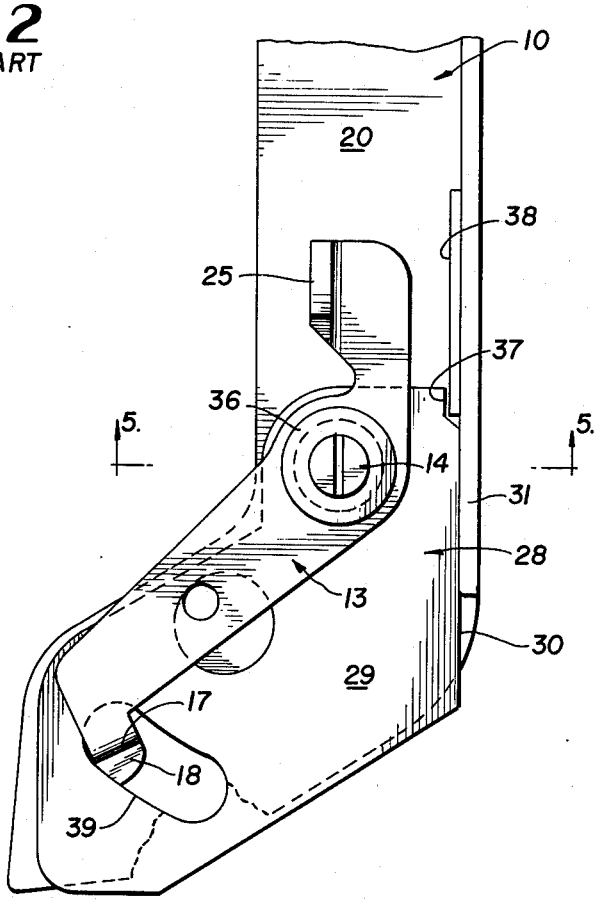
FIG. 3 is an enlarged fragmentary side elevation showing the invention repair or replacement part installed on the broken magazine tip guide and restoring the same to full and complete utility.
Figure 4:
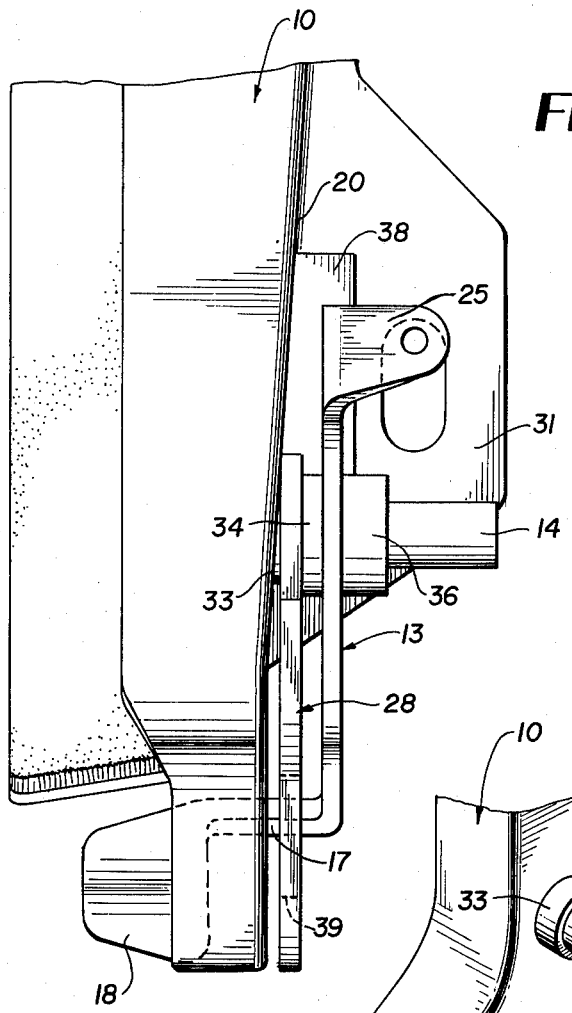
FIG. 4 is an enlarged fragmentary front elevation of the invention shown in FIG. 3.
Figure 5:
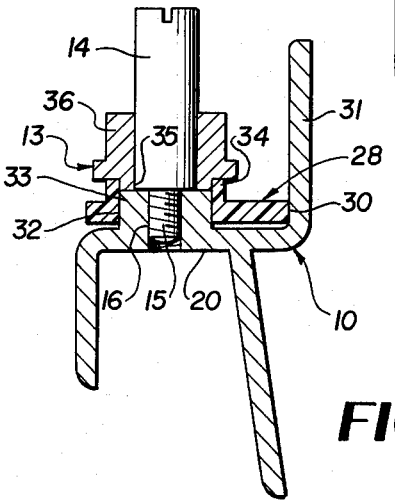
FIG. 5 is a horizontal section taken on line 5—5 of FIG. 3.

Continuing to refer to the drawings and in particular to FIGS. 3 through 6 showing the invention proper, the repair or replacement part 28 previously-noted is a flat plate body 29 formed of a tough durable plastic, phenolic, or metal, if preferred. The element 28 has a marginal shape roughly matching the shape of the lower end portion of magazine tip guide 10. It has a rear straight vertical edge 30 which contacts a rear flange 31 of the tip guide 10 for the purpose of stabilizing the repair part 28 and preventing it from rotating on the axis of fixed shaft extension 14. The element 28 has a bore 32, FIG. 5, to fit over an existing hub 33 projecting from the side wall 20 outwardly. a short integral collar 34 coaxial with the bore 32 in effect extends this bore outwardly so that the bore may receive therein a short sleeve extension 35 on the inner side of quill tip support 13. The quill tip support has a longer coaxial sleeve or hub 36 formed integrally thereon remote from the short sleeve extension 35 to form an adequate bearing surface for the support of the quill tip support 13 on its pivot shaft 14. A feature of the invention is that the placement of the part 28 between the wall 20 of the magazine tip guide 10 and the quill tip support 13 in no way disturbs the geometry or mode of operation of these conventional parts. FIG. 5 shows that the repair part 28 is engaged with the existing hub 33 and the tip guide 10 in such a way that the quill tip support 13 is positioned on the shaft 14 exactly as it would be if the invention were not utilized. It may also be seen that no screws, rivets or the like and no welding or cutting of the existing metal is required to accommodate the repair part 28 on the broken magazine tip guide. The combination of the shaft 14 engaging through the bore 32 of the repair part and the engagement of the edge 30 against the straight flange 31, FIG.3, assures that the part 28 will remain in a fixed and stable position once properly installed. The part 28 is notched at 37 adjacent to its upper rear corner to accommodate an existing pad 38 on the flange 31, as best shown in FIG. 3.

Near its lower end away from the notch 37, the plate-like repair part 28 has an arcuate slot 39 therein which registers with the fractured slot 19 of the magazine tip guide 10. As indicated in FIGS. 3 and 4, the transverse extension 17 of quill tip support 13 extends through and operates within the slot 39 in exactly the same manner as the extension 17 would normally operate in the slot 19 before breakage of the tip guide, as previously described. The repair part 28 can be made of material which is stronger than the metal used to cast the tip guide 10 so that the breakage of the bottom of the slot 39 caused by the pounding of the quill tip support on it will not occur.

In view of the foregoing description, it should be clear that the invention completely solves the annoying and costly problem occasioned by breakage of the bottom of the magazine tip guide 10 in the prior art, as described. The necessity of replacing and refitting the entire tip guide 10 is dispensed with, and instead a single simple plate-like repair part 28 is installed, as described, and this repair part is structured to completely restore the utility of the broken magazine tip guide at very minimal cost and without the need for skilled personnel. The advantages of the invention over the prior art should be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In an automatic loom filling winder having a magazine tip guide for quills, a quill tip support rockably mounted on the magazine tip guide, the tip guide having a slot receiving a moving extension of the quill tip support and one end of the slot tending to break away due to repeated impacts of said extension thereon, the magazine tip guide also having a pivot shaft for the support of said rockable quill tip support projecting from the outer side thereof and having an abutment flange for the rockable quill tip support spaced from one side of said pivot shaft, the improvement comprising a repair plate for said magazine tip guide the use of which obviates the necessity of replacing the tip guide after breaking away of said one end of the slot, said repair plate intervened between the outer side of the magazine tip guide and the rockable quill tip support, said repair plate having a support opening near one end thereof receiving said pivot shaft and having a slot near the other end thereof and spaced from said support opening and being in registration with the broken away slot of the magazine tip guide, and said repair plate having a straight edge portion spaced from one side of the support opening and engaging said rear abutment flange in parallel relation to the flange and resisting rotation of the repair plate around the axis of said support opening.

2. In an automatic loom filling winder as defined in claim 1, said repair plate having an integral collar coaxial with the support opening and projecting beyond one face of the repair plate and toward said rockable quill tip support and engaging the latter, whereby the customary lateral relationship of the quill tip support and magazine tip guide is undisturbed by the repair plate and the repair plate is held in a fixed lateral relationship to the outer side of the magazine tip guide and said quill tip support, whereby said slot of the repair plate can properly receive said moving extension of the quill tip support.

3. In an automatic loom filling winder as defined in claim 2, and said repair plate being unitary and being formed of tough fracture-resistant non-metallic synthetic material.

* * * * *